US005484984A

United States Patent [19]

Gics

[11] Patent Number: 5,484,984

[45] Date of Patent: Jan. 16, 1996

[54] OVENABLE FOOD PACKAGE INCLUDING A BASE WITH DEPENDING LEG MEMBER AND A PLURALITY OF RAISED PORTIONS AND ASSOCIATED FOOD PACKAGES

[75] Inventor: Paul W. Gics, Sewickley Heights, Pa.

[73] Assignee: Gics & Vermee, L.P., Sewickley Heights, Pa.

[21] Appl. No.: 206,564

[22] Filed: Mar. 4, 1994

[51] Int. Cl.[6] ..... H05B 6/80

[52] U.S. Cl. ..... 219/734; 219/730; 219/732; 99/DIG. 14; 426/107; 426/234; 229/125.25; 229/903

[58] Field of Search ..... 219/730, 732, 219/733, 734, 735; 99/DIG. 14; 426/107, 110, 111, 113, 234, 243; 229/901, 902, 903, 125.25, 125.26, 125.27

[56] References Cited

U.S. PATENT DOCUMENTS

| | | | |
|---|---|---|---|
| 3,372,856 | 3/1968 | Erhart et al. . | |
| 3,495,758 | 2/1970 | Wienecke, Jr. . | |
| 3,785,544 | 1/1974 | Smith . | |
| 4,257,530 | 3/1981 | Faller . | |
| 4,260,060 | 4/1981 | Faller | 219/732 |
| 4,286,136 | 8/1981 | Mason, Jr. | 219/732 |
| 4,373,636 | 2/1983 | Hoffman . | |
| 4,398,077 | 8/1983 | Freedman et al. | 219/734 |
| 4,676,857 | 6/1987 | Scharr et al. | 219/730 |
| 4,763,790 | 8/1988 | McGeehins | 206/557 |
| 4,794,005 | 12/1988 | Swiontek | 219/730 |
| 4,841,112 | 6/1989 | Peleg | 219/730 |
| 4,870,233 | 9/1989 | McDonald et al. | 219/730 |
| 4,916,280 | 4/1990 | Havette | 219/732 |
| 4,917,748 | 4/1990 | Harrison | 219/730 |
| 4,939,332 | 7/1990 | Hahn | 219/734 |
| 4,994,638 | 2/1991 | Iorns et al. | 219/734 |
| 5,039,833 | 8/1991 | Woods | 219/730 |
| 5,090,615 | 2/1992 | Hopkins et al. . | |
| 5,234,159 | 8/1993 | Lorence et al. . | |
| 5,310,977 | 5/1994 | Stenkamp et al. | 219/730 |
| 5,352,465 | 10/1994 | Gondek et al. | 426/107 |

FOREIGN PATENT DOCUMENTS

| | | |
|---|---|---|
| 0276654 | 8/1988 | European Pat. Off. . |
| 0327243 | 8/1989 | European Pat. Off. . |
| 0399981 | 11/1990 | European Pat. Off. . |
| 0492052 | 7/1992 | European Pat. Off. . |
| 2164868 | 8/1973 | France . |
| 2629424 | 10/1989 | France . |
| 8604880 | 8/1986 | Germany . |
| 2046060 | 5/1983 | United Kingdom . |
| 8805249 | 7/1988 | WIPO . |
| 9105448 | 4/1991 | WIPO . |

*Primary Examiner*—Philip H. Leung

*Attorney, Agent, or Firm*—Eckert Seamans Cherin & Mellott; David V. Radack

[57] ABSTRACT

An ovenable food package for holding a food product. The package has a base which is constructed and arranged such that at least one exterior gap is created between the base and the support surface of the oven (conventional or microwave) in which the package and food product are placed into to be cooked. The base is also constructed and arranged to create at least one interior gap between the food product and the base. A further ovenable food package is disclosed in which a lid is provided that is adapted to be removed and then replaced on top of the package to create a space between the food product and the lid. A food package including a base for the food product and a box containing the base and food product is also disclosed.

3 Claims, 6 Drawing Sheets

OVENABLE FOOD PACKAGE INCLUDING A BASE WITH DEPENDING LEG MEMBER AND A PLURALITY OF RAISED PORTIONS AND ASSOCIATED FOOD PACKAGES

BACKGROUND OF THE INVENTION

This invention relates to a food package that can be placed directly in a conventional or microwave oven along with the food product which is packaged therein.

Packaged foods, such as packaged frozen foods, are manufactured and sold extensively throughout the United States and the world. These foods offer the consumer a convenient alternative to preparing foods from "scratch". For example, frozen pizzas are sold which, typically, are packaged with a paperboard base and shrink wrapping. These pizzas can be placed either in a conventional oven or a microwave oven. When it is desired to heat the pizza in a conventional oven, the shrink wrapping and the paperboard base are removed and discarded and the frozen pizza is placed on a cookie sheet or aluminum foil and then placed into the conventional oven.

For microwave frozen pizzas, it is known to provide a package consisting of a box which contains the frozen pizza. The box includes microwave susceptor material. In use, the box is opened and placed in the microwave oven along with the pizza and then subjected to microwave energy.

There are several problems with current ovenable food packages. For microwavable food packages, if the package rests on a part of the oven which acts as a heat sink to conduct heat away heat from the receptor material, it takes longer to heat the food product than should be necessary. Also, the food product tends to be heated non-uniformly, thus causing "cold spots" in the food product. Another major problem with many microwavable food packages is that moisture contained in the food product causes steam, and this steam must escape the product in order to avoid sogginess. In many "closed packages" the steam cannot escape. Finally, and especially for microwavable frozen pizzas, the cheese toppings can melt and overflow over the sides of the crust and under the crust causing sticking of the pizza to the package, a phenomenon known in the trade as "wicking".

The above problems are also present with other microwavable food products such as french fries, pocket sandwiches, pies and bakery products. In addition, food manufacturers, because of the above problems, have not made other microwavable food products that could be made and marketed if the above problems were not present.

What is needed, therefore, is an ovenable food package that can be placed into a conventional or microwave oven along with the food product desired to be cooked. The ovenable food package needed not only must facilitate uniform and efficient heating of the food product, but also must be constructed and arranged such that sogginess of the cooked food product is avoided.

SUMMARY OF THE INVENTION

The ovenable food package of the invention has met the above-mentioned needs. The ovenable food package includes a base which is constructed and arranged such that at least one exterior gap is created between the base and the support surface of an oven (conventional or microwave) when the base is placed on the support surface. The base is also constructed and arranged such that at least one interior gap is created between the food product and the base when the food product rests on the base. This construction and arrangement insures uniform and efficient heating of the food product and also insures that moisture in the form of steam can escape from the food product so that the food product comes out of the oven crispy and not soggy.

In another embodiment of the invention, a microwavable food package includes a base, a sidewall extending from the base that terminates in a stepped flange a lid having at least one portion which can be folded when the lid is placed into contact with the stepped flange. In this way, when the lid is removed from the package and is unfolded, the lid can rest on the stepped flange portion to create a space between the lid and the food product.

A final embodiment of a microwavable ovenable food package comprises a base constructed and arranged as was set forth above in the first embodiment, with the base and the food product being contained within a box.

BRIEF DESCRIPTION OF THE DRAWINGS

A full understanding of the invention can be gained from the following description of the preferred embodiment when read in conjunction with the accompanying drawings in which.

DETAILED DESCRIPTION

Figure 1:
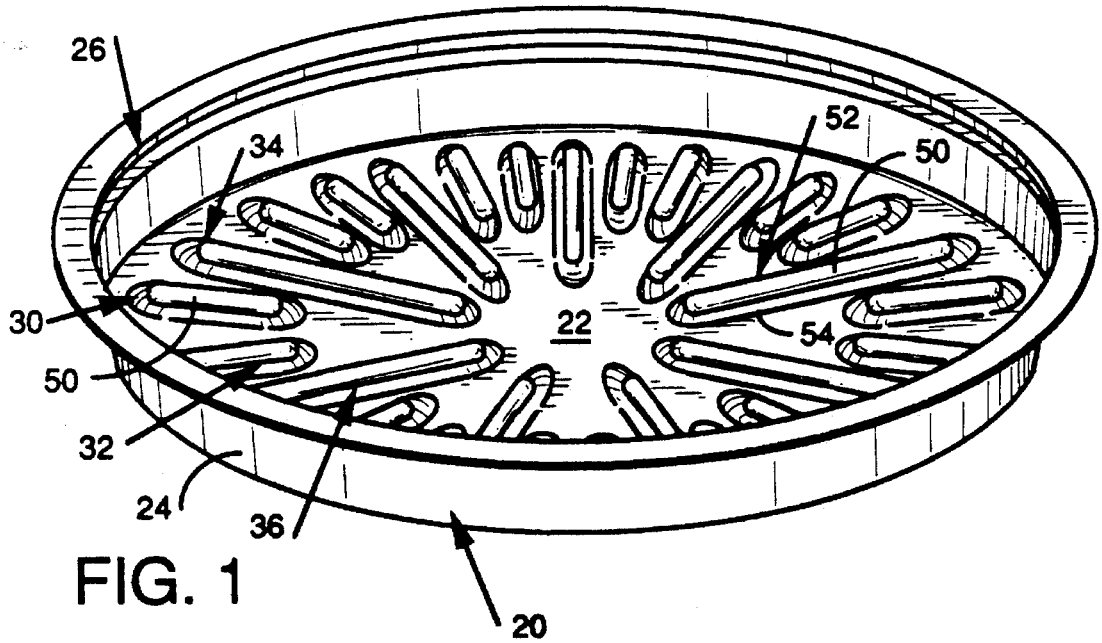
FIG. 1 is a perspective view of an ovenable food package.
Figure 2:
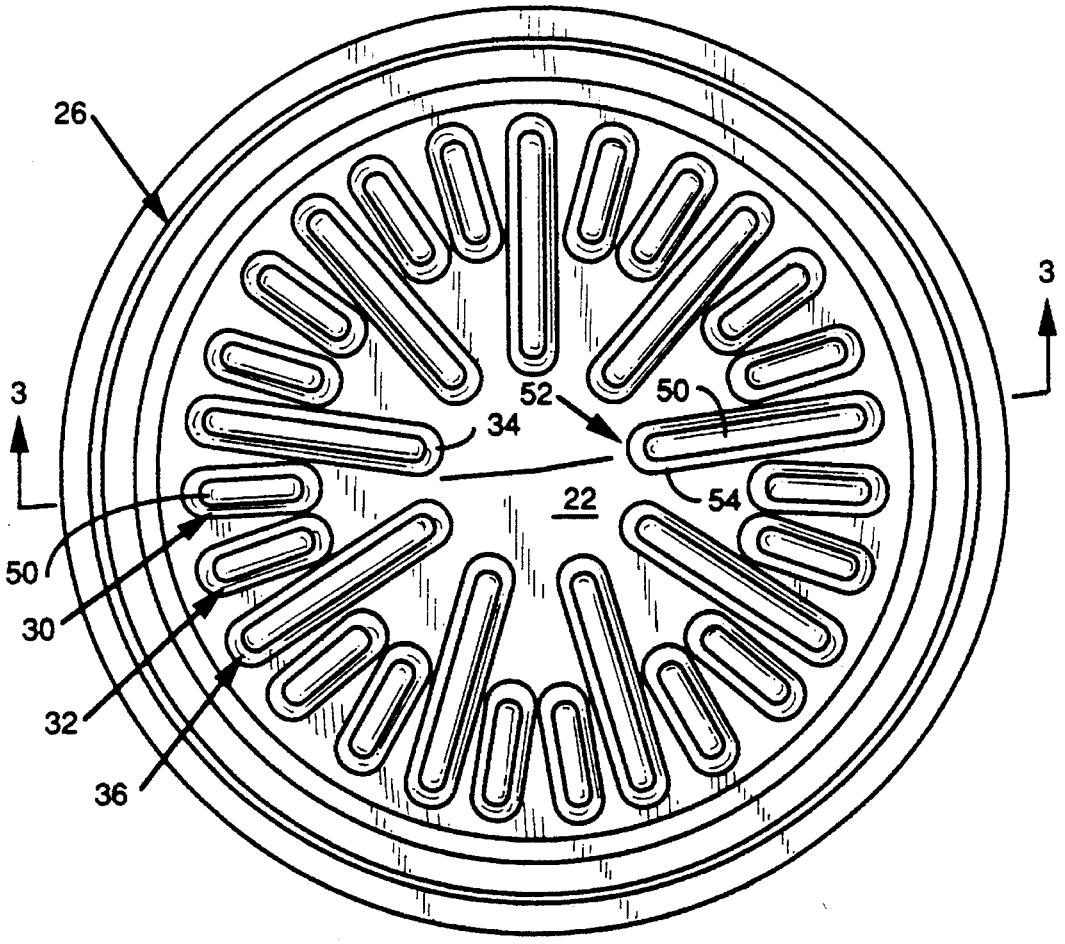
FIG. 2 is a top plan view of the package of FIG. 1.
Figure 3:
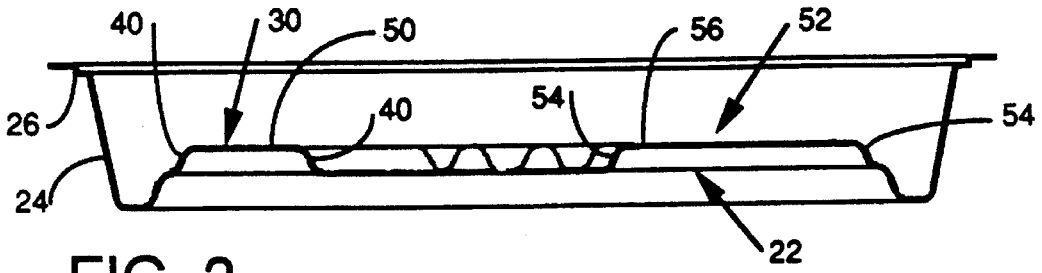
FIG. 3 is a sectional view taken through line 3—3 of FIG. 2.

Referring to FIGS. 1–3, an ovenable food package is shown. The package includes a base 20 which consists of a paperboard that is coated with a high temperature coating on the interior. For microwavable food packages, a microwave susceptor material (such as aluminum, alumina or carbon) is disposed between the paperboard base and the high temperature coating. The microwavable base is made by providing a web of paperboard and sputtering aluminum material thereon before the high temperature coating is applied. The material for the base can be purchased commercially from International Paper Co.

The flat material is constructed and arranged to have the general shape shown in FIGS. 1–3. This is done by using conventional die cutting techniques well known to those skilled in the art. It will be appreciated that the exact size of the base 20, as well as the shape and dimension of the various sections of the base 20 can vary, just as long as the general function and the general construction and arrangement of the base 20 (as will be discussed below) is preserved. It will also be appreciated that even though an ovenable pizza package is shown, the general concepts of the invention apply equally to other ovenable food products such as, for example, french fries, pocket sandwiches, pies and bakery products that come in packages having circular, oval, rectangular, triangular or square shapes.

The base consists of a floor portion 22 and a sidewall portion 24 that extends upwardly from the floor portion 22. The sidewall portion 24 terminates in a stepped flange member 26. The stepped flange member 26 is used to secure a cover means to the base 20, as will be discussed below.

The base 20 has integrally formed therein a plurality of raised ovals with two smaller ovals such as ovals 30, 32 being sandwiched by two larger ovals 34, 36 with this pattern being repeated around the base 20. The ovals, such as oval 30 has sidewall 40 (FIG. 3) that extends upwardly and inwardly from the floor portion 22 of the base 20 and then terminates in a central plateau 50. Similarly, larger oval 52 is raised from floor 22 and has a sidewall 54 that extends upwardly and inwardly from the floor portion 22 of the base 20 and then terminates in a central plateau 56.

Figure 4:
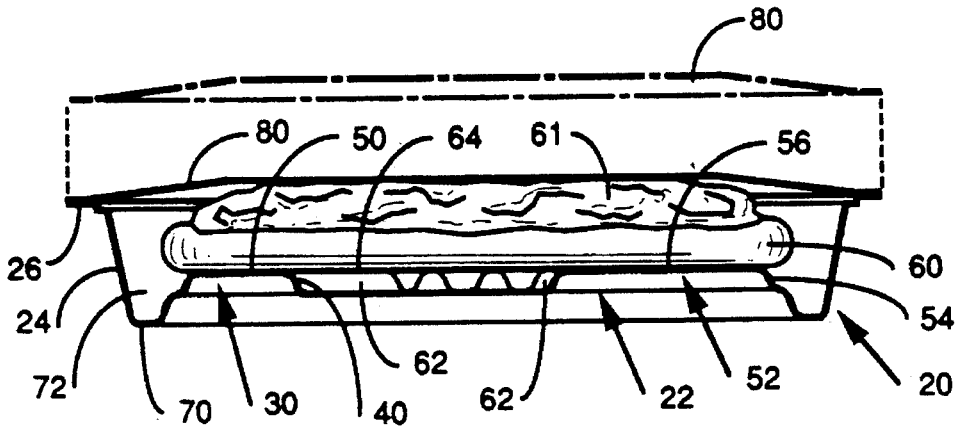
FIG. 4 is a vertical section showing a pizza resting on the package with a lid means disposed thereon.

Referring now to FIG. 4, the base 20 is shown with a frozen pizza 60 having toppings 61 placed thereon. The pizza 60 is supported on the plateaus of the ovals, such as plateaus 50 and 56 as shown in FIG. 4. It will be appreciated that an interior gap 62 is maintained between the bottom portion of the pizza crust 64 and the floor portion 22 of the base 20. In addition, the base includes an outer circumferential leg portion 70 defined by the sidewall 24 and the floor portion 22. The leg portion 70 defines a collection reservoir 72 which serves the dual purpose of collecting any loose toppings 61 from the pizza 60 and also any melted cheese that cascades over the side of the pizza 60 while the pizza 60 is cooking. This latter function will prevent "wicking" which is when melted cheese comes between the pizza crust 64 and the floor portion 22 and thus causing sticking of the pizza crust 64 to the floor portion 22.

FIG. 4 also shows lid 80 in phantom line drawing and in full line drawing. The full line drawing shows the lid being placed on the flange portion 26 of the base 20. It will be appreciated that the base is dimensioned such that the top of the pizza 60 (the portion containing the toppings 61) extends above the flange portion 26 as shown in FIG. 4. The lid 80, which can be made of paperboard, is resilient and thus can bow in the middle as is shown in FIG. 4 and preferably contacts the toppings 61 on the pizza 60. In addition, the flange portion 26 can also bend to facilitate the bowing of the lid 80, by being pivotable with respect to the sidewall 24. This will resist the toppings 61 from becoming dislodged from the pizza 60 after packing of the pizza 60, during shipment of the pizza 60 from the manufacturer to the grocery store and finally during transportation of the pizza 60 from the grocery store to the end use environment.

It will be appreciated that other covering means, such as shrink wraps, can be used for packing the pizza. In use, the lid 80, or other cover means, is removed and discarded by the consumer and the pizza 60 is placed directly into the microwave or conventional oven along with the base 20.

Figure 5:
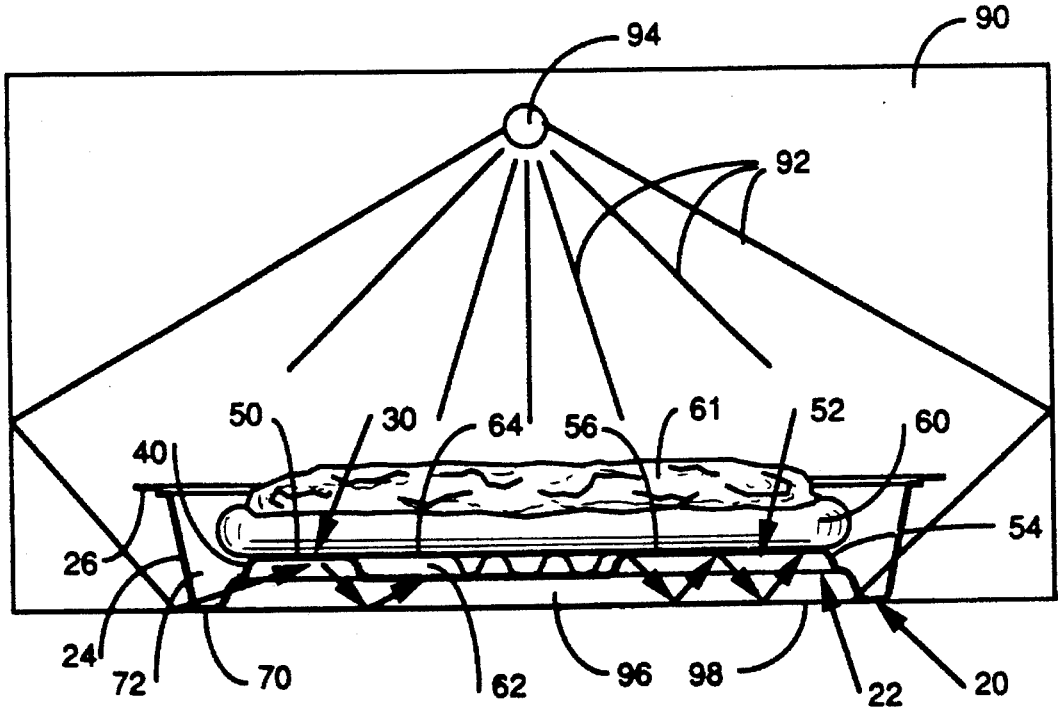
FIG. 5 is a vertical section showing the package of FIG. 1 with a pizza resting thereon with both the pizza and the package being placed in a microwave oven.

Referring to FIG. 5, the base 20 with pizza 60 thereon is shown as placed in a microwave oven 90. The microwaves 92 from microwave source 94 heat the pizza 60. The base 20 is constructed and arranged such that an exterior gap 96 is formed between the base 20 and the support on which the base 20 rests when the pizza 60 is being cooked, which in this case is the floor 98 of the microwave oven 90. In this way the base 20 and the floor 98 do not act as heat sink to draw away the heat created by the microwaves 92 in cooking the pizza 60. This leads to uniform heating of the entire pizza and also the elimination of so-called "cold spots" in the pizza.

It will also be appreciated that the interior gaps 62 created between the pizza 60 and the base also enhance the uniform heating of the pizza. Furthermore, the steam created by moisture in the frozen pizza which is heated is able to be vented from the bottom of the pizza 60 thus preventing sogginess of the pizza and creating a crispy crust. This steam also creates a "steam blanket" that enhances melting of the cheese on top of the pizza 60. In effect, the package acts as a small baking oven.

Figure 6:
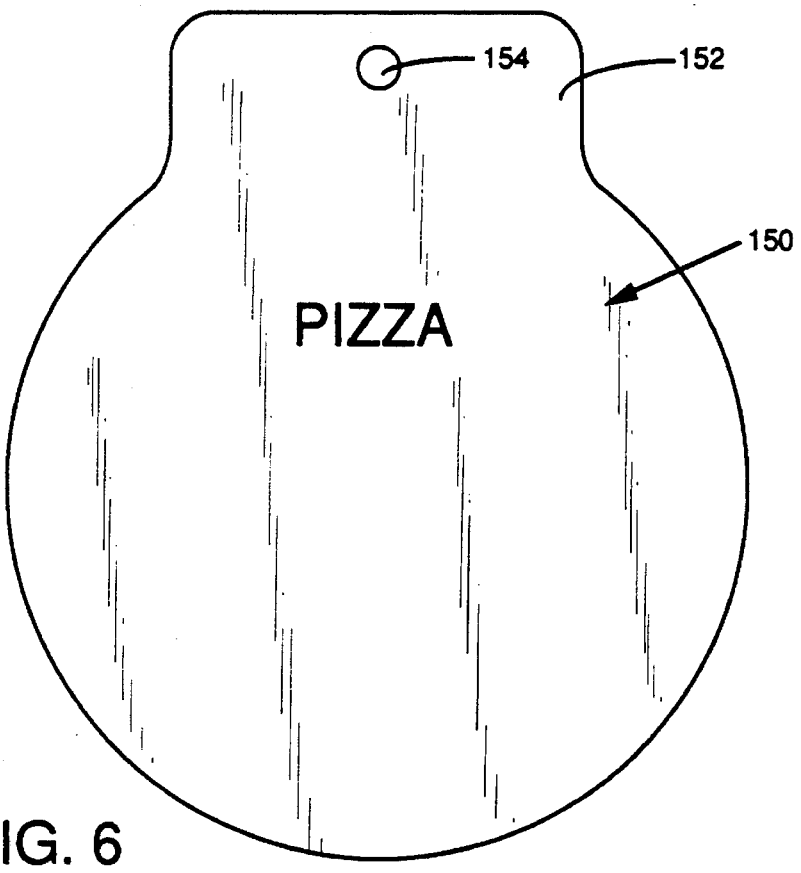
FIG. 6 is a top plan view of a peggable lid for the food package.
Figure 7:
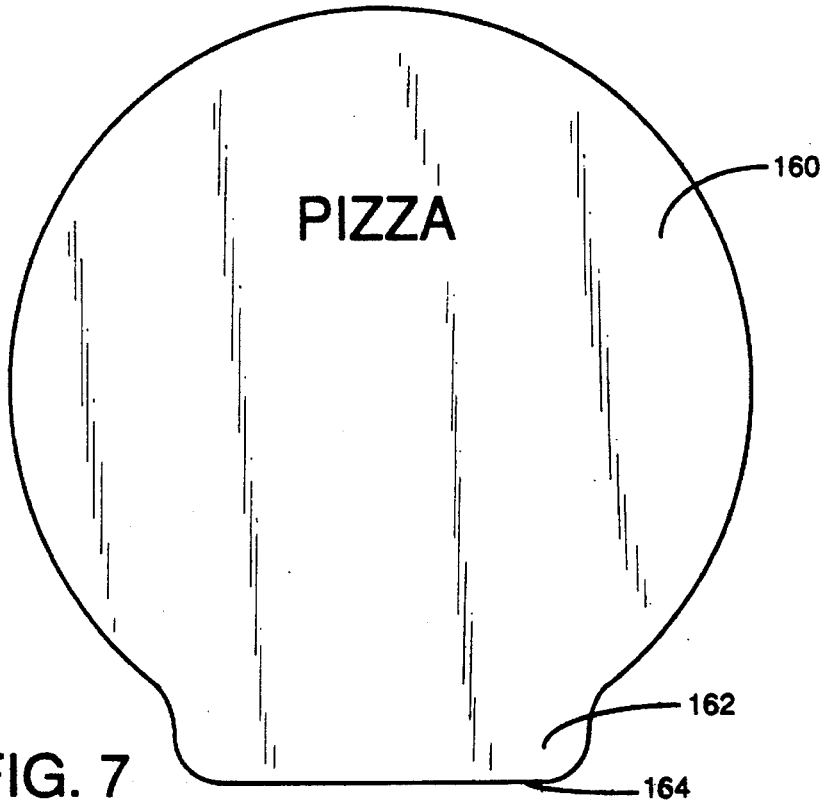
FIG. 7 is a top plan view of a lid having support means so that the food package can stand upright.
Figure 8:
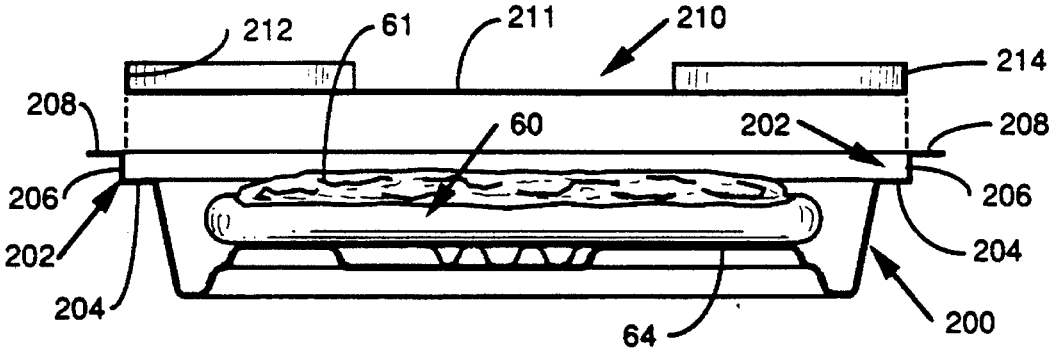
FIG. 8 is a cross-sectional view of another embodiment of a food package.

FIGS. 6 and 7 show two different embodiments for paperboard lids that can be used in association with the base 20 of the invention. FIG. 6 shows a peggable lid 150, in which the lid has a flange portion 152 defining a peg hole 154. These lids can be used in association with pegs provided in the grocer's freezer so that the pizza package is displayed in an upright manner. This provides a neat and attractive method of displaying the pizza package.

FIG. 7 shows a standable lid 160 in which a flange 162 is provided that is adapted to having the bottom edge 164 act as a stand so that the pizza package again can stand in an upright manner.

Figure 9:
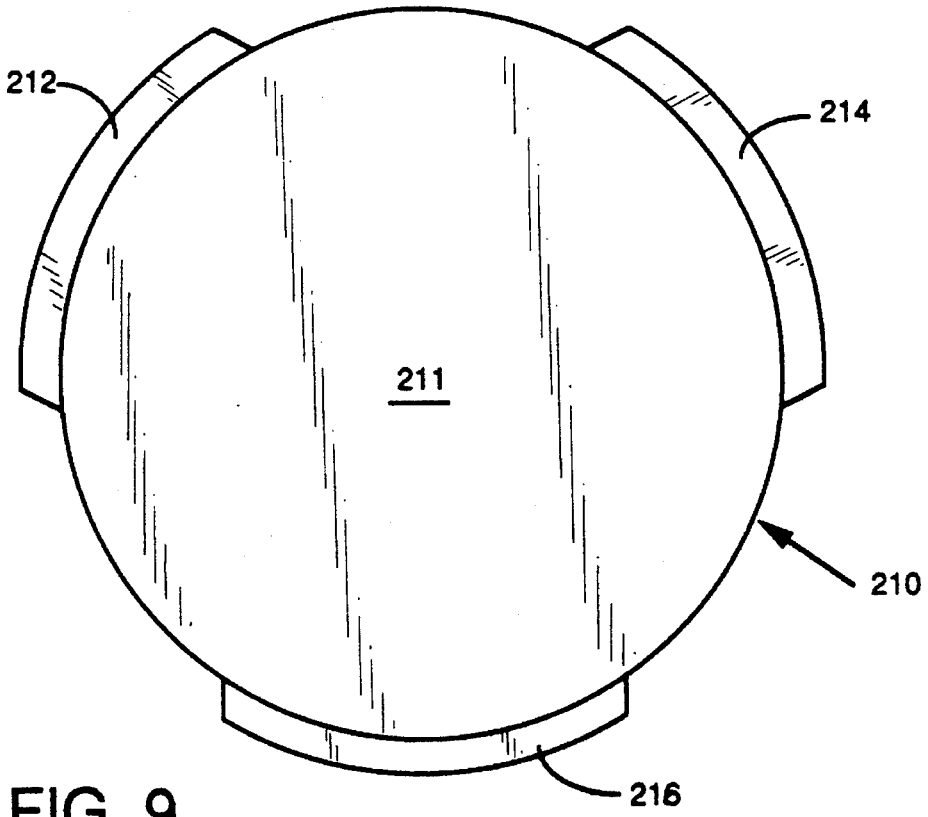
FIG. 9 is a top plan view of the lid of the embodiment shown in FIG. 8 with the flaps extended.
Figure 10:
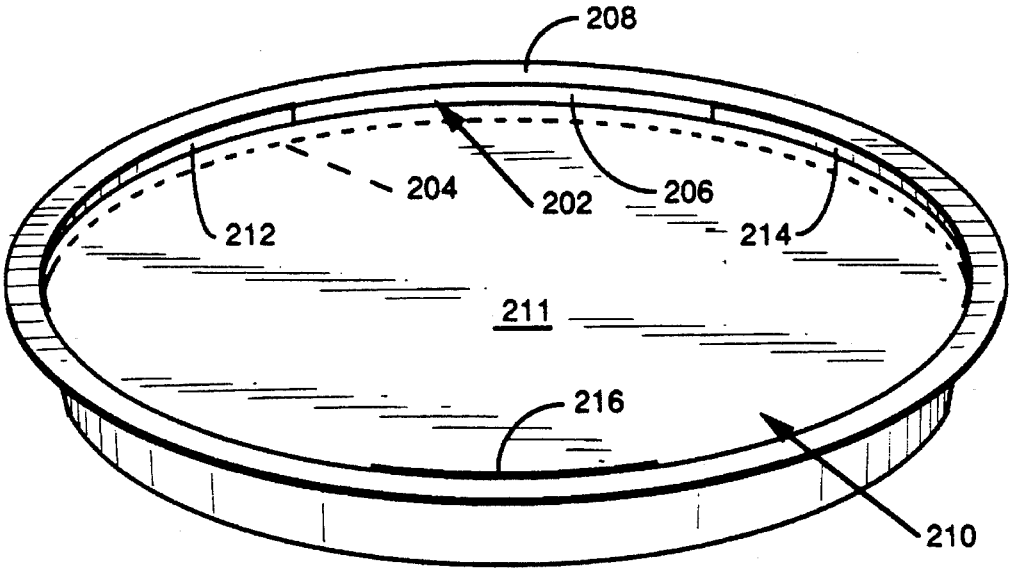
FIG. 10 is a detailed perspective view of the assembled food package of FIG. 8 showing the lid being in position on the base.
Figure 11:
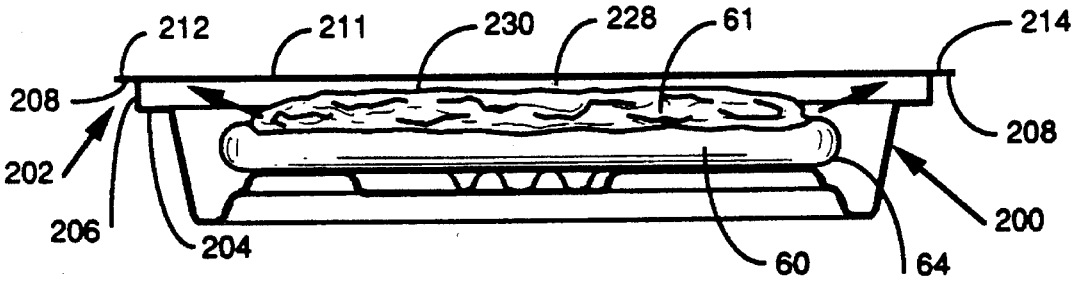
FIG. 11 is a view similar to the view of FIG. 8 only showing the lid removed and replaced on top of the sidewall of the base of the food package.

FIGS. 8–11 illustrate another embodiment of the ovenable food package of the invention. In this embodiment a base 200, similar in construction and arrangement to base 20, is provided. This base 200, however, is provided with a step flange 202 having a lower horizontal portion 204, a vertical portion 206 and an upper horizontal portion 208. The lid 210, as shown in FIG. 9, has a central portion 211 and three flange portions 212, 214, 216 extending from the main body thereof. As can best be seen in FIG. 10, the flange portions 212, 214, 216 are folded upwardly and are disposed in step flange 202. When it is desired to cook the pizza 60, the lid 210 is removed from the base 200, and the flange portions 212, 214, 216 are unfolded so that they are co-planar with central portion 211 of the lid 210 (as shown in FIG. 9). At that point, the lid 210 is placed back on the base 200, with flange portions only being supported by the horizontal upper portion 208 of the step flange 220. As shown in FIG. 11, this creates a space 228 between the top of the pizza 230 and the lid 210. This will act to vent the steam and also to use the steam to effectively heat the toppings 61 on the pizza 60. The steam forms a "steam blanket" in the space 228 which enhances melting of the cheese on top of the pizza 230.

Figure 12:
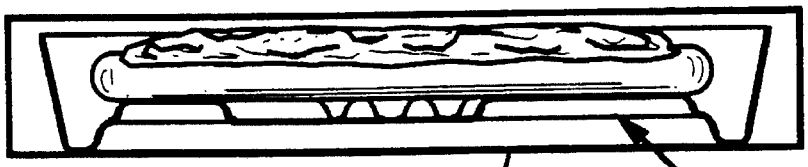
FIG. 12 is a vertical section of yet another embodiment of a food package.

FIG. 12 shows yet another embodiment in which the base 250 (similar in construction and arrangement to base 20 and 200) having pizza 60 disposed thereon (the cover means is not shown) being contained in an outer box 260. The outer box 260 acts to trap the steam created when cooking the pizza, similarly to lid 210.

It will be appreciated that an ovenable food package has been disclosed which can be safely used in both conventional and microwave ovens and the like.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A package for containing a food product, said package supporting said food product when said food product is placed into a food heating apparatus having a support surface, said package comprising:

a base;

a sidewall extending from said base, said sidewall having a stepped flange portion; and lid means having at least one portion which is folded so that said lid is complementary to said stepped flange portion when said lid means is placed into contact with said stepped flange and such that when said lid means is removed from said package and is unfolded, said lid means can rest on a portion of said stepped flange portion to create a space between said lid means and said food product.

2. The package of claim 1, wherein said base is constructed and arranged such that at least one exterior gap is created between said base and said support surface when said package is placed in said food heating apparatus and such that at least one interior gap is created between said food product and said base when said food product rests on said base.

3. The package of claim 1, wherein said lid means is heat sealed to said stepped flange.

* * * * *